US009887484B1

(12) United States Patent
Hu

(10) Patent No.: US 9,887,484 B1
(45) Date of Patent: Feb. 6, 2018

(54) TWO-PART FLOATING ELECTRIC CONNECTOR

(71) Applicant: Amphenol East Asia Electronic Technology (Shen Zhen) Co., Ltd., Shenzhen (CN)

(72) Inventor: Haixi Hu, Shenzhen (CN)

(73) Assignee: Amphenol East Asia Electronic Technology (Shen Zhen) Co., Ltd., Baoan District, Shenzhen, Guangdong (CN)

( * ) Notice: Subject to any disclaimer, the term of this patent is extended or adjusted under 35 U.S.C. 154(b) by 0 days.

(21) Appl. No.: 15/434,445

(22) Filed: Feb. 16, 2017

(51) Int. Cl.

| | |
|---|---|
| ***H01R 13/629*** | (2006.01) |
| ***H01R 13/502*** | (2006.01) |
| ***H01R 13/428*** | (2006.01) |
| ***H01R 12/58*** | (2011.01) |
| ***H01R 24/60*** | (2011.01) |
| *H01R 107/00* | (2006.01) |

(52) U.S. Cl.
CPC ..... *H01R 13/502* (2013.01); *H01R 12/585* (2013.01); *H01R 13/428* (2013.01); *H01R 24/60* (2013.01); *H01R 2107/00* (2013.01)

(58) Field of Classification Search
CPC ..... H01R 13/6315
USPC ..... 439/247, 248
See application file for complete search history.

(56) References Cited

U.S. PATENT DOCUMENTS

| | | | | | |
|---|---|---|---|---|---|
| 5,201,663 | A * | 4/1993 | Kikuchi | H01R 13/6315 | 439/248 |
| 5,259,779 | A * | 11/1993 | Ooya | H01R 13/6315 | 29/856 |
| 5,306,168 | A * | 4/1994 | Kunishi | H01R 13/6315 | 439/248 |
| 5,575,673 | A * | 11/1996 | Dahlem | H01R 13/6315 | 439/248 |
| 6,155,858 | A * | 12/2000 | Ozawa | H01R 13/6315 | 439/248 |
| 6,752,642 | B2 * | 6/2004 | Ushiro | H01R 13/743 | 439/248 |
| 7,125,260 | B2 * | 10/2006 | Orita | H01R 12/57 | 439/247 |
| 7,354,279 | B2 * | 4/2008 | Uesaka | H01R 12/57 | 439/660 |

(Continued)

*Primary Examiner* — Neil Abrams
(74) *Attorney, Agent, or Firm* — Howard IP Law Office, PA

(57) ABSTRACT

The present application relates to the field of electric connector, particularly to an electric connector. The electric connector comprises a fastening body, a floating body and a plurality of electric terminals. The fastening body includes stop grooves, the floating body includes stop protrusions, and the electric terminals include resilient segments. The fastening body can overlap the outside of the floating body. The two stop protrusions are respectively located at the two sides of the floating body, and are respectively clutched in the two stop grooves when the fastening body 1 overlaps the outside of the floating body. The electric terminals are divided into two sets and are plugged into the fastening body and the floating body at the same time when the fastening body overlaps the outside of the floating body. The resilient segments are respectively located at one end of the electric terminals and are made by folding each electric terminal into a two layer structure.

12 Claims, 1 Drawing Sheet

(56) References Cited

U.S. PATENT DOCUMENTS

| | | | | |
|---|---|---|---|---|
| 7,887,350 | B2 * | 2/2011 | Fukazawa | H01R 12/707 439/247 |
| 8,257,095 | B2 * | 9/2012 | Akai | H01R 12/716 439/248 |
| 8,628,361 | B2 * | 1/2014 | Kato | H01R 12/585 439/751 |

* cited by examiner

TWO-PART FLOATING ELECTRIC CONNECTOR

TECHNICAL FIELD

The present application relates to the field of electric connector, particularly to an electric connector.

BACKGROUND

An electric connector is an electrical device for transferring a current. The electric connectors used specifically in server field must allow for a current of 50 A, which gives rise to hidden risks upon its electric leakage. Electric leakage likely occurs due to improper plug-in between the plug and socket of the electric connector during the usage of the electric connector.

SUMMARY OF THE APPLICATION

To solve the above described technical problem, the present application provides a new electric connector, which is floatable relative to the plug by optimizing its structures, provides a better plug-in and match between itself and the plug, and allows a current of 50 A to run through.

To achieve the above described objective, the present application provides an electric connector comprising:

a fastening body, which includes stop grooves;

a floating body, which includes stop protrusions; and a plurality of electric terminals, which respectively include resilient segments, wherein the fastening body can overlap the outside of the floating body;

the stop protrusions are respectively located on the two sides of the floating body, and respectively clutched in the stop grooves when the fastening body overlaps the outside of the floating body;

the electric terminals are divided into two sets, and are plugged into the fastening body and the floating body at the same time when the fastening body overlaps the outside of the floating body; and the resilient segments are located at one end of the electric terminals and are made by folding each electric terminal into a two layer structure.

In a further optimized embodiment, the floating body includes vertical floating stops located at its front and back sides, and transverse floating stops located at its left and right sides, wherein the vertical floating stops abut against the inner surfaces of the front and back sides of the fastening body, and the transverse floating stops abut against the inner surfaces of the left and right sides of the body, when the fastening body overlaps the outside of the floating body.

In a further optimized technical solution, the electric terminals include outer clutching regions and inner clutching regions respectively located at the outer layer structures and inner layer structures of the resilient segments, wherein the outer clutching regions and the inner clutching regions may be respectively clutched in the fastening body and the floating body, when the fastening body overlaps the outside of the floating body; and the resilient segments are respectively provided between the outer clutching regions and the inner clutching regions.

In a further optimized technical solution, there are four vertical floating stops which are respectively located on both ends of the front side and those of the back side of the floating body.

In a further optimized technical solution, the electric terminals include fisheye structures which are located at the ends of the resilient segments and are connected with PCB.

Compared with the prior art, the beneficial effects of the present application are that: the new electric connector is floatable relative to the plug by optimizing its structures and provides a better plug-in and match between itself and the plug.

The optimized structures are characterized in that:

there are resilient segments at the ends of the electric terminals made by folding the electric terminal into a two layer structure, and when the plug is improperly plugged into the socket, the resilient segments are deformed (pressed transversely and pulled longitudinally);

after the floating body is plugged into the fastening body, there is still remaining space within the fastening body for the floating body to move therein, the size of which is determined by the distances between the vertical floating stops and the transverse floating stops. The deformation of the resilient segments can be eliminated through movement of the floating body since the outer and inner clutching regions are respectively clutched in the floating body and the fastening body, accordingly, the tolerance to deflected plug-in posture of the present connector is therefore improved.

DETAILED DESCRIPTION

The present application will be described in detail in connection with FIGS. 1 to 2 and the specific embodiments as well, which are in no way intended to limit the present application.

Embodiment 1

Figure 1:
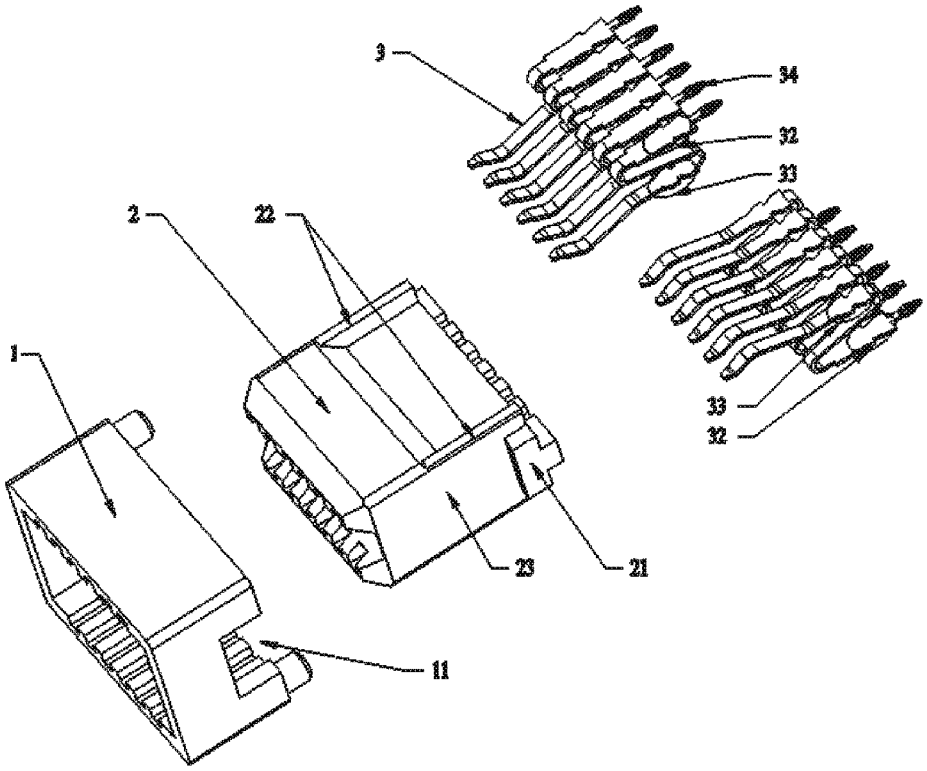
FIG. 1 is an exploded view of the electric connector according to the present application.
Figure 2:
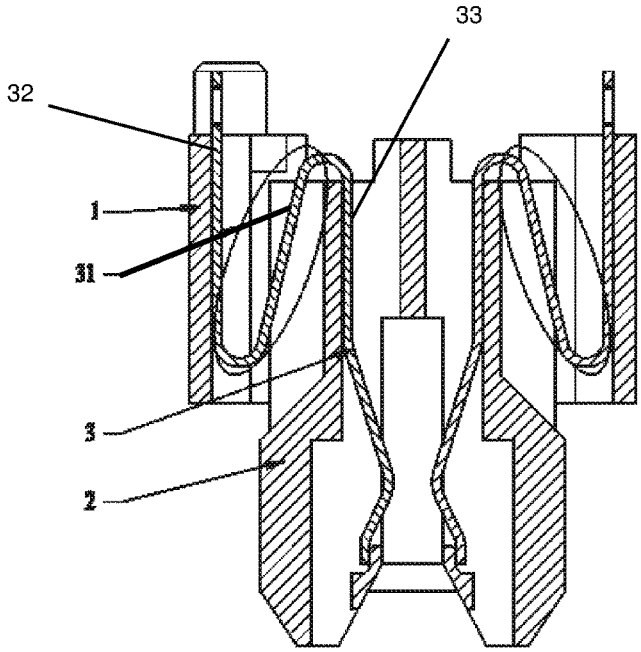
FIG. 2 is a cross sectional view of the electric connector according to the present application.

As shown in FIGS. 1 and 2, a new electric connector comprises a fastening body 1, a floating body 2 and a plurality of electric terminals 3. The fastening body 1 includes two stop grooves 11, the floating body 2 includes two stop protrusions 21, and the electric terminals 3 include resilient segments 31.

The fastening body 1 can overlap the outside of the floating body 2. The two stop protrusions 21 are respectively located on the two sides of the floating body 2, and are respectively clutched in the two stop grooves 11 when the fastening body 1 overlaps the outside of the floating body 2.

The electric terminals 3 are divided into two sets, and are plugged into the fastening body 1 and the floating body 2 at the same time when the fastening body 1 overlaps the outside of the floating body 2.

The resilient segments 31 are located at one end of the electric terminals 3 and are made by folding each electric terminal into a two layer structure.

The floating body 2 includes vertical floating stops 22 located at its front and back sides, and transverse floating stops 23 located at its left and right sides. When the fastening body 1 overlaps the outside of the floating body 2, the vertical floating stops 22 abut against the inner surfaces of the front and back sides of the fastening body 1, and the transverse floating stops 23 abut against the inner surfaces of the left and right sides of the fastening body 1.

The electric terminals 3 include outer clutching regions 32 and inner clutching regions 33 respectively located at the outer layer structures and inner layer structures of the resilient segments 31. The resilient segments 31 are respectively located between the outer clutching regions 32 and the inner clutching regions 33. When the fastening body 1 overlaps the outside of the floating body 2, the outer clutching regions 32 and the inner clutching regions 33 are able to be respectively clutched in the fastening body 1 and the floating body 2.

There are four vertical floating stops 22, which are respectively located on both ends of the front side and those of the back side of the floating body 2.

The electric terminals 3 include fisheye structures 34, which are located at the ends of the resilient segments 31 and are connected with PCB.

In light of the general technical knowledge, the present technical solutions can be achieved by other embodiments which are not departed from the spiritual substance or essential features of the present application. Therefore, the above described embodiments are only illustrative in any way and are not intended to limit the application. All the changes within the range of the application or its equivalent are included in the application itself.

The invention claimed is:

1. An electric connector comprising:

a fastening body, which includes stop grooves;

a floating body, which includes stop protrusions; and a plurality of electric terminals, which include resilient segments, wherein the fastening body can overlap the outside of the floating body, wherein the stop protrusions are respectively located on the two sides of the floating body, and respectively clutched in the stop grooves when the fastening body overlaps the outside of the floating body, wherein the electric terminals are divided into two sets and are plugged into the fastening body and the floating body at the same time when the fastening body overlaps the outside of the floating body, wherein the resilient segments are located at one end of the electric terminal and are made by folding each electric terminal into a two layer structure, and wherein the floating body includes vertical floating stops respectively located at its front and back sides such that, when the fastening body overlaps the outside of the floating body, the vertical floating stops abut against the inner surfaces of the front and back sides of the fastening body.

2. The electric connector as set forth in claim 1 wherein, the floating body includes transverse floating stops respectively located at its left and right sides such that the transverse floating stops abut against the inner surfaces of the left and right sides of the body.

3. The electric connector as set forth in claim 1, wherein the electric terminals include outer clutching regions and inner clutching regions respectively located at the outer layer structures and inner layer structures of the resilient segments, wherein the resilient segments are respectively located between the outer clutching regions and the inner clutching regions, and wherein when the fastening body overlaps the outside of the floating body, the outer clutching regions and the inner clutching regions may be respectively clutched in the fastening body and the floating body.

4. The electric connector as set forth in claim 1, wherein there are four vertical floating stops, which are respectively located on both ends of the front side and those of the back side of the floating body.

5. The electric connector as set forth in claim 1, wherein the electric terminals include fisheye structures, which are located at the ends of the resilient segments and can be connected with PCB.

6. The electric connector as set forth in claim 1, wherein the two sides of the floating body are adjacent to both the front and back of the floating body.

7. The electric connector as set forth in claim 1, wherein the vertical floating stops are disposed such that relative movement between the front of the floating body toward and away from the fastening body is allowed.

8. The electric connector as set forth in claim 2, wherein, when the fastening body overlaps the outside of the floating body, a relative movement between the floating body and the fastening body is controlled by the dimensions of the vertical floating stops and the transverse floating stops.

9. The electric connector as set forth in claim 1, wherein at least one of the vertical floating stops includes an inner face configured so as to extend toward a closest side of the floating body as the inner face extends away from the front side.

10. The electric connector as set forth in claim 2, wherein a horizontal wall extends from the front side of the floating body so as to connect to the vertical floating stops on the front side of the floating body, the horizontal wall extending from the floating body in a direction other than perpendicular to the front side.

11. The electric connector as set forth in claim 1, wherein the inner clutching regions extend away from the resilient segments in a direction parallel the outer clutching regions, then extends away from the outer clutching regions.

12. The electric connector as set forth in claim 1, wherein the inner clutching regions include a bent portion configured to fix the inner clutching regions to the floating body.

* * * * *